US005398431A

United States Patent [19]

Beihoffer et al.

[11] Patent Number: 5,398,431

[45] **Date of Patent: * Mar. 21, 1995**

[54] SINGLE STAGE SNOWTHROWER IMPELLER

[75] Inventors: Randall A. Beihoffer, Bloomington; Floyd D. Niskanen, Golden Valley, both of Minn.

[73] Assignee: The Toro Company, Minneapolis, Minn.

[ * ] Notice: The portion of the term of this patent subsequent to Feb. 21, 2009 has been disclaimed.

[21] Appl. No.: 474,432

[22] Filed: Feb. 2, 1990

Related U.S. Application Data

[63] Continuation-in-part of Ser. No. 467,709, Jan. 19, 1990, abandoned.

[51] Int. Cl.[6] ..... E01H 5/09

[52] U.S. Cl. ..... 37/249; 37/254; 37/247; 37/258

[58] Field of Search ..... 37/209, 213, 225, 233, 37/240, 244, 249, 251, 254, 256–259, 262, 246, 248

[56] References Cited

U.S. PATENT DOCUMENTS

| | | | |
|---|---|---|---|
| 2,642,680 | 6/1953 | Curtis et al. | 37/266 |
| 2,714,772 | 8/1955 | Erickson | 37/248 |
| 3,359,661 | 12/1967 | Speiser et al. | 37/262 |
| 3,452,460 | 7/1969 | Cope et al. | 37/233 |
| 3,548,522 | 12/1970 | Roper | 37/233 |
| 3,603,008 | 9/1971 | Heth | 37/252 |
| 3,913,247 | 10/1975 | Ruhl | 37/251 X |
| 4,295,285 | 10/1981 | Stevens | 37/246 |
| 4,322,896 | 4/1982 | Miyazawa et al. | 37/233 |
| 4,325,195 | 4/1982 | Comer | 37/227 |
| 4,651,452 | 3/1987 | Husso | 37/225 |
| 4,694,594 | 9/1987 | Thorud et al. | 37/244 |

*Primary Examiner*—Dennis L. Taylor
*Assistant Examiner*—Spencer Warnick
*Attorney, Agent, or Firm*—James W. Miller

[57] ABSTRACT

A snowthrower (20) including an improved impeller (50) which has an "open center" configuration and which is substantially made from a single piece of plastic. Impeller (50) includes a pair of curved blades (60) which are supported, braced and stiffened by a plurality of "spiders" (62, 64, 66, 68, 72, 74, 76 and 78) which form recesses for receiving a shaft (42) which spans between the side walls (36) of the snowthrower housing (22). Curved blades (60) of impeller (50) extend transversely between a pair of somewhat circular plates (52, 54). Plates (52, 54) preferably include teeth (**54*b*, 54*c*, 52*b*, 52*c*) which help to break up snow and ice and assist in propelling snowthrower (20**).

12 Claims, 8 Drawing Sheets

SINGLE STAGE SNOWTHROWER IMPELLER

This application is a continuation-in-part of U.S. patent application Ser. No. 07/467,709, filed Jan. 19, 1990, now abandoned.

FIELD OF THE INVENTION

The present invention relates generally to single stage snowthrowers, and more particularly to impellets for same.

BACKGROUND OF THE INVENTION

Powered snowthrowers of the type wherein the operator walks behind and guides the machine are well known and are generally either single stage or two stage. Two stage snowthrowers include two rotating snow handling elements, each of which is directly or indirectly coupled to the snowthrower's prime mover. The first stage typically includes a low speed, high torque rotating element which breaks up the snow and ice and augers it to the second stage element, a "fan." Rotating at higher speed than the auger, the fan propels the snow and ice upwardly through an adjustable discharge chute assembly.

A single stage snowthrower, by contrast, has only one snow handling element, an "impeller." Rotating about a horizontal axis, the impeller includes a plurality of paddles which extend radially outwardly from the impeller axis. The impeller is partially enclosed by a housing which is open in the front and has spaced side walls connected by a rear wall. The impeller spans between and is rotatably supported by the housing side walls. The lower portion of the housing rear wall is curved to conform to and closely shroud the impeller, whereas the upper portion of the housing rear wall is typically more or less planar, and extends upwardly to a set of guide vanes or a discharge chute. In operation, the impeller paddles draw the snow into the housing and against the arcuate lower portion of the rear wall. The snow continues up the rear wall upper portion and is ultimately discharged through the vanes or chute. The impeller of a single stage snowthrower must therefore single-handedly do the job of the auger and fan of a two stage machine, i.e., it must break up the snow, draw it into the housing, and propel it with considerable force up and out of the housing and away from the machine.

There are additional differences between typical single and two stage snowthrowers. For example, single stage machines are usually lighter, less powerful and less expensive than two stage machines, and commercially viable single stage machines, particularly ones with electric prime movers, must work within these constraints. This places additional demands on the single stage impeller. It must be inexpensive, light weight and efficient in terms of avoiding "losses" of various types which would waste the prime mover's limited power. Potential losses would include inertial, frictional (impeller to ground and impeller to snow), air resistance and snow slippage or leakage losses (slippage of the snow and ice between the outer tips of the impeller paddles and the arcuate lower portion of the housing rear wall). Impellers should also be capable of breaking up crusted snow and ice, to a degree, and work in such a way that they do not tend to clog the housing or stall or overload the prime mover under normal conditions.

Several different types of single stage impellers have been developed. One type of impeller includes a plurality, typically two, of flat paddles coupled to a horizontally rotating shaft or drum. The paddles typically include metallic (e.g., aluminum) inner flanges which hold flat plastic or rubber "blades." Such impellers are "closed" in the sense that the paddles are solid, without apertures sufficient to allow snow to pass through, from the centerline of the impeller to the outer radial edge thereof. This type of impeller is used on the gas engine powered S620 single stage snowthrower sold by The Toro Company, assignee herein. Such "closed," at least partially metal, impellers are fairly effective in terms of breaking up and throwing snow, but as a class they possess several characteristics which make them somewhat disadvantageous for some applications. For one thing, they are somewhat costly to produce inasmuch as they include aluminum or steel flanges or drums and require some assembly, i.e., attaching the rubber blades to the metal flanges. Another problem with such impellers is that they are fairly heavy, both from the standpoint of gross weight and rotational inertia. Thirdly, "closed" impellers encounter considerable air resistance because of the size of their paddles. Finally, the "closed" design of the flat paddles sometimes causes the prime mover to overload or stall in heavy, wet snow conditions since there are no internal passages within the impeller through which the snow can pass. Some flat paddle, closed impeller designs allow so much snow to slip around the outer tips of the blades that they avoid stalling the prime mover, but this is clearly disadvantageous from the standpoint of efficiency. "Closed" impellers also fail to produce much air flow. Applicants believe that a single stage impeller is preferably capable of pumping a considerable volume of air, and that this characteristic is particularly important in terms of throwing, or actually blowing, extremely dry, fluffy snow. Gas powered single stage snowthrowers having a flat bladed, metal flanged impeller can overcome some of the problems discussed above simply by brute force, and rubber bladed flat paddles are in fact quite useful in the sense that they help propel the machine along, making it virtually self-propelled in some cases. Electrically powered single stage machines having such impellers, however, suffer in their performance, as a class. Self propelling is not as important for the light weight electric models. Moreover, flat rubber paddles tend to flex under load and are somewhat difficult to fabricate and assemble. The flexing, wear and inherent impreciseness of flat rubber blades make it difficult to maintain a reasonably close fit between the impeller and the arcuate lower rear wall of the housing. This causes unnecessary leakage of snow around the outer tips of the "closed" paddles, and snow leakage of this type is particularly problematical for electric snowthrowers since they don't have the power to overcome such inefficiencies.

To address some of the problems associated with metallic/elastomeric flat paddled impellers, a curved paddle single stage impeller was developed. This impeller, shown in U.S. Pat. No. 4,694,594 which has been assigned to the assignee herein, has proven to have a particularly advantageous configuration when applied to gas-powered snowthrowers. Each paddle includes a central snowthrowing section which is curved forwardly from its midpoint to each side thereof to be concave, with the central section extending over at least about the middle 50% of the entire paddle's length. Two curved end sections are smoothly connected to the curved central section and are shaped to function as augers for moving a controlled volume of snow inwardly onto the central snowthrowing section. While this complex shape has been found to be very effective, this impeller is still made using the metal flange/elastomeric blade construction described above, and it is still a "closed" impeller. The metal flange/elastomeric blade construction makes it difficult to maintain precise dimensions for the curves, angles and housing fit, so efficiency is compromised to a degree. These characteristics render it less than ideal for electric snowthrowers, in particular.

In view of some of the problems discussed above in connection with metallic/elastomeric impellers, plastic impellers were developed. One type of plastic single stage impeller is represented by U.S. Pat. Nos. 3,452,460, issued to Cope et al., and 3,548,522, issued to Roper. These impellers have "closed" curved plastic paddles attached to a shaft or drum rotated by a snowthrower prime mover. While this type of impeller is lighter than prior metal flange/rubber blade impellers and might perhaps reduce some of the "losses" associated with closed, flat paddle, metal/rubber impellers, this type of impeller still possesses several disadvantages. A primary one is that such an impeller is still "closed," and can therefore cause or contribute to the stalling or overloading of the prime mover in heavy, wet snow conditions. Also, this type of impeller would still be fairly expensive to produce in that separate paddles have to be attached to a shaft, adding fastener cost and assembly time to the overall cost of the impeller; and the tolerance buildup of assembly requires more clearance to the housing, causing unnecessary snow slippage around the outer tips of the blades.

Another type of plastic impeller is represented by U.S. Pat. Nos. 4,295,285 and 4,325,195, issued to Stevens and Comer, respectively, and assigned to The Toro Company, assignee herein. The Stevens and Comer snowthrowers are small, electrically-powered "Power Shovel" devices. The impellers are only about 11 inches wide and about 4 inches in diameter. They are "open" impellets in that they have a substantially open center to help avoid prime mover overload and to pump more air to enhance the removal of light, fluffy snow. The impellets shown in these references are also similar in that they include flat paddles. Comer and Stevens differ, however, in the way that the impeller is supported and driven. In Comer, a full length shaft, coupled to the prime mover, supports the paddles. Torque is transmitted from one end of the impeller to the other through this shaft. By contrast, in the Stevens reference there is no through shaft. Torque or power is applied to one end of the impeller and is transmitted by the flat plastic blades across the entire length of the impeller. While the Comer and Stevens impellets address many of the problems associated with the prior art, primarily because of their "open" configuration, they possess certain shortcomings, as well, particularly when applied to snowthrowers larger than the Power Shovel type. For example, the blades of Comer and Stevens are flat. It has been found that curved impellers having a particular shape possess several advantages. Reference is again made to U.S. Pat. No. 4,694,594, issued to Thorud et al., and assigned to the present assignee. Although the open design flat blade rotor of Comer and Stevens does pump air and throw light fluffy snow out of the housing, wind quickly disperses it, whereas an open curved rotor pumps the light fluffy snow into a concentrated stream that can be directed where desired and is much less prone to dispersal by the wind. Also, Comer's impeller is not substantially made of one piece of plastic. The blades or vanes are attached to circular plates by means of right angle tabs or the like. Finally, neither of the impeller shaft configurations shown in Comer and Stevens is optimum for larger snowthrowers. The Comer impeller includes a through shaft to which is attached the blades of the impeller. This adds cost and unnecessary rotational inertia to the impeller. While Stevens does not include a through shaft, it also does not include anything to stabilize or prevent distortion of the impeller under load. While distortion of an impeller, which could cause snow leakage or slippage around the outer tips of the blades, is probably not much of a problem for a Power Shovel type (i.e., small, low power) snowthrower, impeller distortion could significantly diminish the performance of a larger, higher power machine. Moreover, the Stevens and Comer impellers include large circular "spiders" extending from the axis of the impeller to the blades, presumably to strengthen the impeller and to act as a ground bearing structure. The spiders are the same size and shape as the circular end plates which are adjacent to the housing side walls. The large, circular spiders potentially reduce air flow and certainly increase weight, rotational inertia, and frictional (impeller to ground and impeller to snow) losses.

Also, the Comer and Stevens impellers do not include means specifically designed for breaking up crusted snow and ice. In fact, fully round spiders will tend to slide over hard snow and prevent the blades from hitting the snow. Even if the flat impeller blades themselves can theoretically serve this function to a degree, the Power Shovel prime mover, a relatively small electric motor, is not particularly well suited for this purpose.

The present invention addresses the above-noted problems associated with prior art single stage snowthrower impellers. That is, the present invention is directed toward a single stage snowthrower impeller which is very efficient, very effective in throwing all types of snow, cost effective, applicable to mid to large single stage walk-behind snowthrowers, and, in preferred embodiments, can break up crusted snow and ice and propel the snowthrower to a degree. The impeller of the present invention is particularly well suited for electric single stage snowthrowers.

SUMMARY OF THE INVENTION

Accordingly, in broad terms the invention is an impeller for a single stage snowthrower of the type having a housing and a prime mover associated therewith, wherein the impeller is rotatably mounted within the housing and includes a pair of end plates, at least one of the end plates being coupled to the prime mover; a plurality of circumferentially spaced curved blades extending laterally between the end plates, each blade comprising a central snow throwing section curved forwardly from a mid plane to each side thereof to be concave, and a pair of curved auger sections smoothly connected to the sides of the central section and adjacent to the end plates; and a plurality of spiders extending radially between the blades, wherein the impeller forms a substantially open center between the blades and is substantially made from a single piece of plastic.

In preferred embodiments, the end plates include teeth suitable for breaking up snow and ice and propelling the snowthrower; the spiders are noncircular and elongate; the impeller is fabricated from a single piece of injection-molded plastic; the shaft which supports the impeller is "passive" and torque is transmitted from one end plate to another through the curved blades; and the plastic is high density polyethylene.

BRIEF DESCRIPTION OF THE DRAWING

The invention is described with reference to the Drawing, in which.

DETAILED DESCRIPTION OF PREFERRED EMBODIMENT

Figure 1:
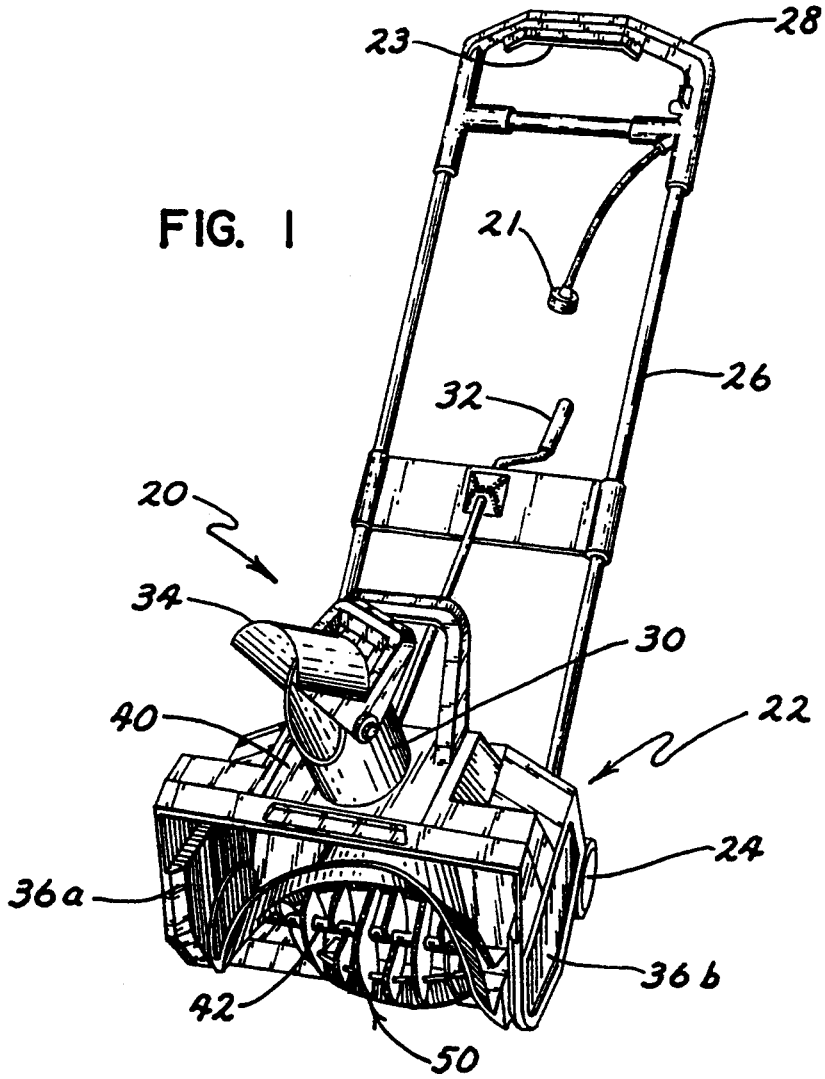
FIG. 1 is a perspective view of a single stage snowthrower incorporating a preferred impeller according to the invention.

A preferred embodiment of the invention will now be described with reference to the Drawing, wherein like reference numerals designate like parts and assemblies throughout the several views.

FIG. 1 shows a preferred single stage snowthrower 20 according to the invention. Snowthrower 20 includes a housing 22 supported in conventional fashion by a set of wheels 24. Extending upwardly and rearwardly from housing 22 is a handle 26, the top of which forms a hand grip 28. Pivotably mounted atop housing 22 is a discharge chute 30, which can be adjusted from side to side using a hand crank 32. A vertically adjustable deflector 34 is pivotably connected to discharge chute 30. A set of adjustable vanes could be used rather than chute 30.

Snowthrower 20 is an electrically-powered device in the preferred embodiment. Thus it includes a plug 21 which can connect to an extension cord (not shown) which in turn can be plugged into a 110 volt AC receptacle. Hand grip 28 preferably carries a switch bar 23 which can be selectively depressed by the operator to activate an electric motor 100 (see FIG. 13) contained within housing 22.

Housing 22 is formed by a pair of laterally-spaced side walls **36*a* and 36*b* interconnected by a rear wall 38 (see FIG. 13) having an arcuate lower portion 38*a* and a substantially planar upper portion 38*b* extending upwardly and slightly forwardly therefrom. Discharge chute 30 is pivotably supported by a housing top wall 40 which, like housing rear wall 38, spans transversely across the entire width of snowthrower 20. Also spanning between side walls 36, within the interior of housing 22, is a horizontal impeller shaft 42. Shaft 42, in the preferred embodiment described herein, is not driven by the snowthrower prime mover, but is instead rotationally fixed to side walls 36. Alternatively, shaft 42 could be allowed to freewheel relative to side walls 36. Generally, it is preferred that shaft 42 be "passive" in the sense that it not be actively driven by the snowthrower prime mover. Shaft 42** can be a 0.500 inch diameter steel rod.

Figure 13:
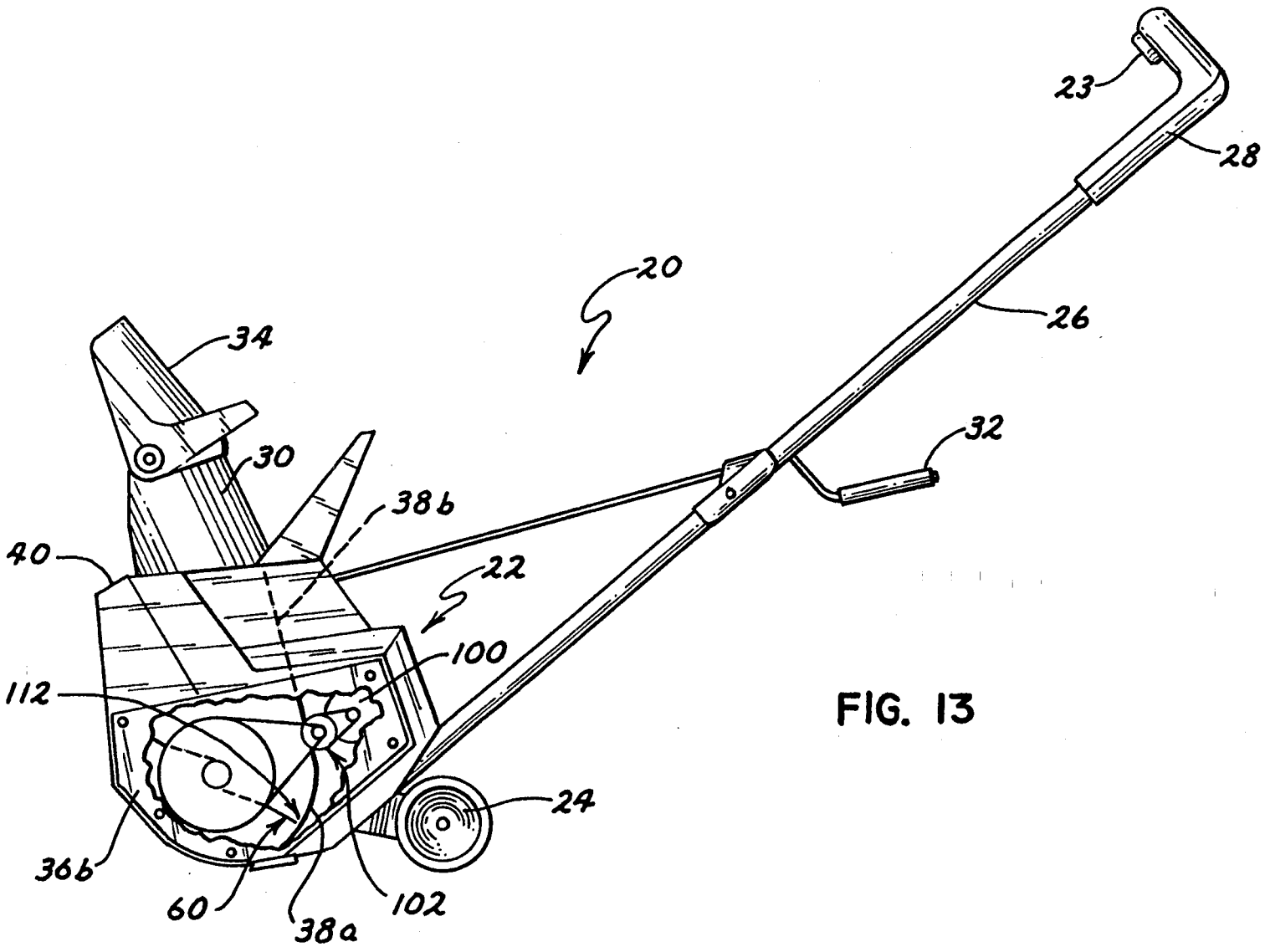
FIG. 13 is a side elevational view of the snowthrower of FIG. 1.

Housing 22 also partially encloses an impeller 50. Impeller 50 is preferably apertured to receive, and can freely rotate about, shaft 42. As shown in FIG. 13, electric motor 100 can be coupled to impeller 50 using a belt and pulley system 102. When switch bar 23 is depressed 110 VAC power is applied to motor 100, which drives impeller 50 through belt and pulley system 102. The present invention contemplates any of a wide variety of drive systems for impeller 50.

Figure 2:
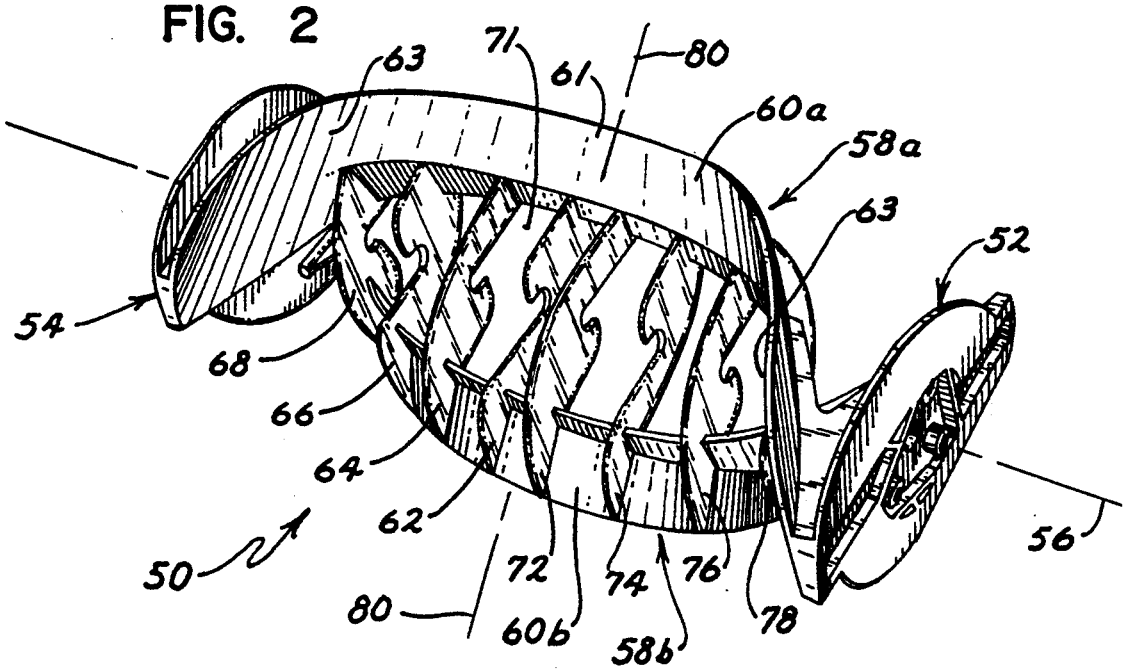
FIG. 2 is an enlarged perspective view of the impeller of FIG. 1.
Figure 3:
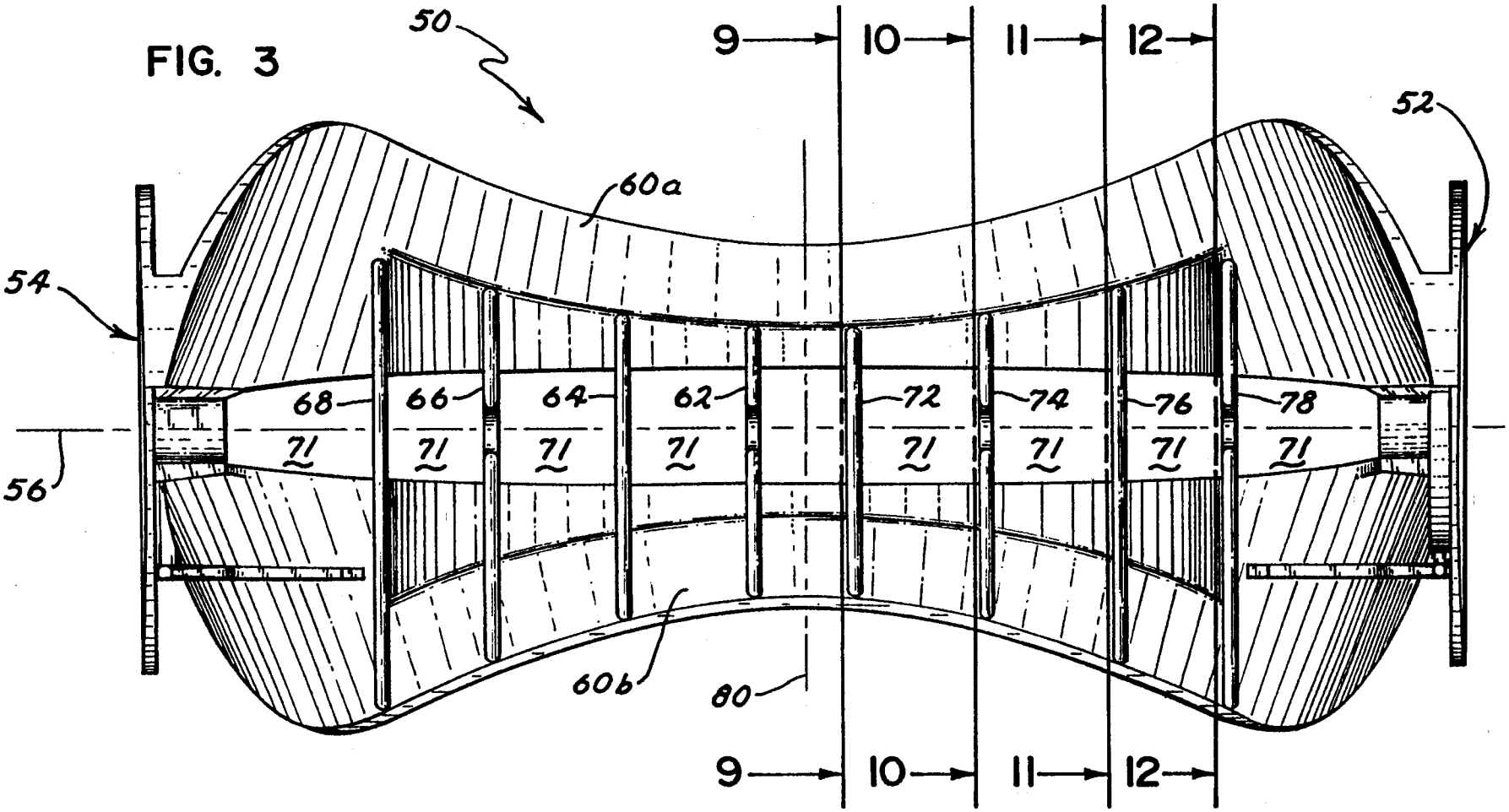
FIG. 3 is a front elevational view of the impeller of FIG. 2.
Figure 4:
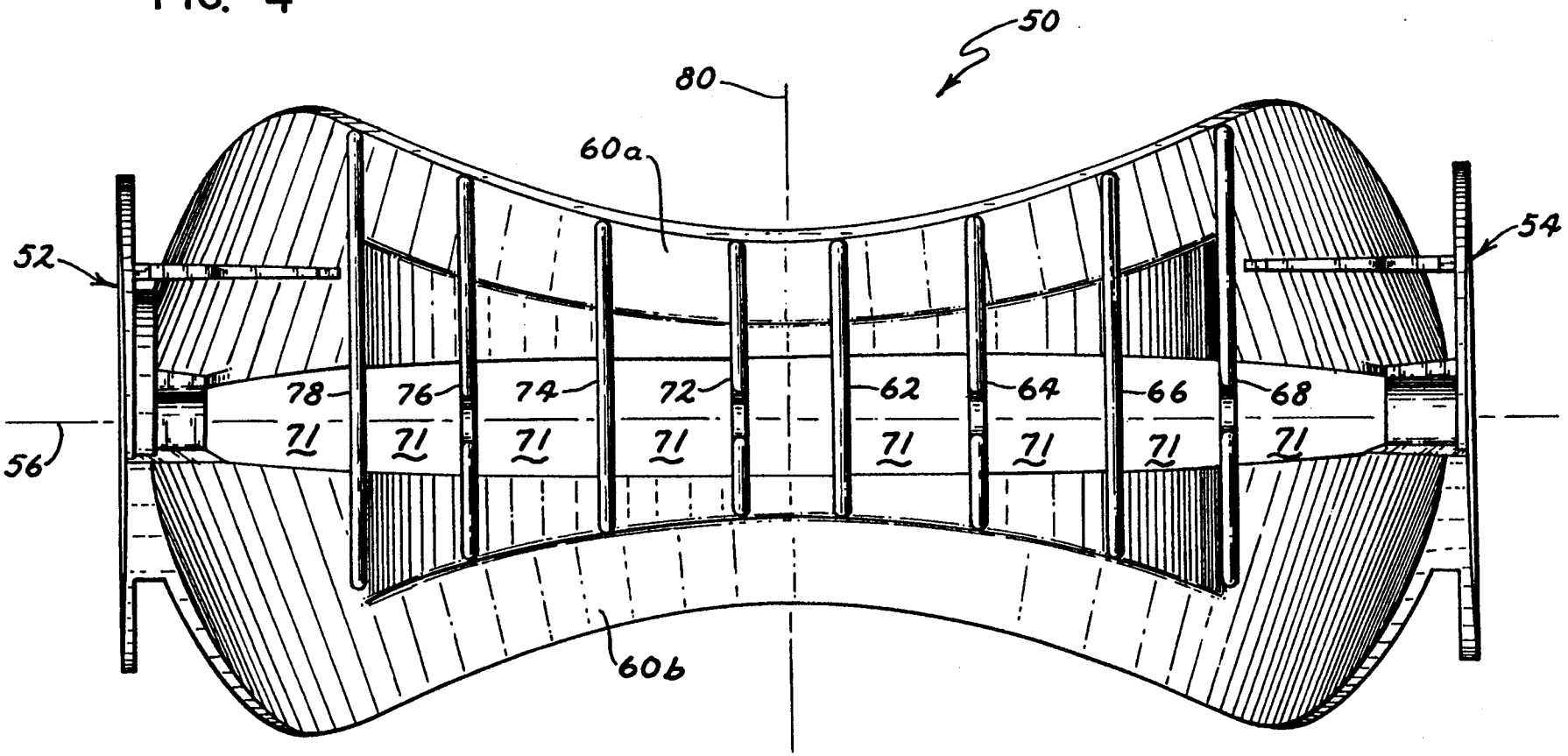
FIG. 4 is a rear elevation view of the impeller of FIG. 2.

As shown in FIG. 2, impeller 50 includes a pair of laterally-spaced, generally circular end plates 52 and 54. End plate 52 is coupled to prime mover 100 through the use of belt and pulley system 102 described above. Thus, end plate 52 is termed the "driven" end plate. By contrast, end plate 54 is, in the preferred embodiment, not coupled to prime mover 100, and can therefore be called the "free" end plate. In a preferred embodiment, end plates 52 and 54 are 7 inches in diameter. Extending between end plates 52 and 54, and radiating outwardly from an impeller axis 56 is, in broad terms, a pair of paddles **58*a* and 58*b*. Each paddle 58 includes a curved blade 60 connected to end plates 52 and 54 and radially supported by a plurality of "spiders" 62, 64, 66, 68, 72, 74, 76 and 78**.

The shape of blades 60 and in fact the overall shape of impeller 50 closely follows that of the "closed" steel/-rubber impeller disclosed in U.S. Pat. No. 4,694.594. incorporated herein by reference. Thus, each blade 60 includes a central snowthrowing section 61 which is curved forwardly from a mid plane 80 to each side thereof to be concave, with the central section 61 extending over at least about the middle 50% of the entire paddle's length. Two curved end sections 63 are smoothly connected to the curved central section 61 and are shaped to function as augers for moving a controlled volume of snow inwardly onto the central snowthrowing section 61.

Figure 9:
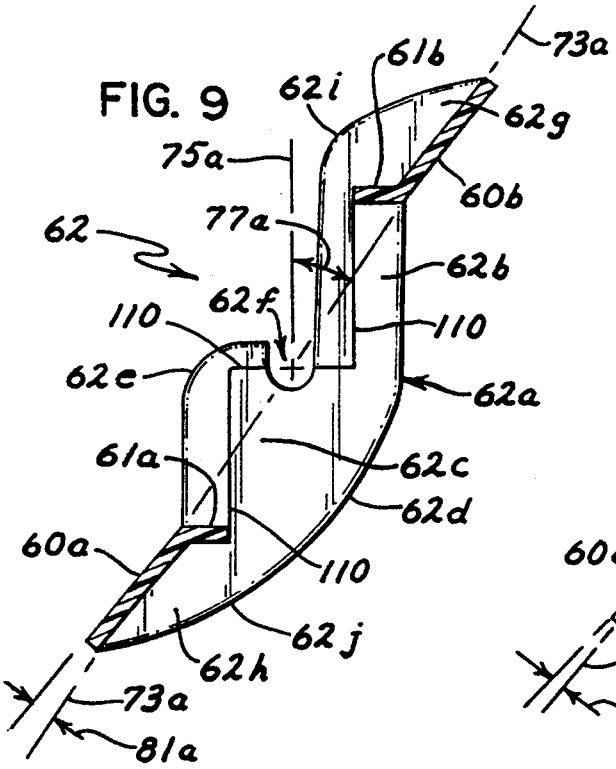
FIG. 9 is a side view, taken generally along line 9—9 of FIG. 3, of one of the inner spiders of the impeller of FIG. 2.

As noted above, blades 60 are supported and braced by a plurality of spiders 62, 64, 66, 68, 72, 74, 76 and 78. The spiders are in sets of opposed pairs. Specifically, spiders 62 and 72; 64 and 74; 66 and 76; and 68 and 78, respectively, form four sets of opposing pairs. For example, spiders 62 and 72, which can be called "inner" spiders due to their proximity to mid plane 80, are preferably substantially identical except for the fact that they are rotated 180° relative to one another. Furthermore, they are equally spaced from the mid plane 80 of impeller 50. Inner spider 62 is shown in FIG. 9, but it should be recognized that inner spider 72 is preferably identical thereto but for its orientation. Similarly, spiders 64 and 74 are identical except for the fact that they are rotated 180° relative to one another. Spiders 64 and 74, termed "mid-inner" spiders, are also equally displaced from impeller mid plane 80. The same relationship exists between "mid-outer" spiders 66 and 76; and "outer" spiders 68 and 78. FIGS. 9–12, respectively, show spiders 62, 64, 66 and 68. Since all of the spiders are analogous in their structure and function, it will suffice to describe in some detail the construction of inner spider 62, shown in FIG. 9.

Inner spider 62 radially spans between blades 60*a* and 60*b*, near mid plane 80. In broad terms, inner spider 62 includes a two-legged spider body 62*a* having a first leg 62*b* and a second leg 62*c*. Spider body 62*a* has a smooth, arcuate edge 62*d* on one side and a shaft receiving edge 62*e* on the opposite side thereof. Shaft receiving edge 62*e* forms a shaft recess 62*f* which is open on one end (the top end in FIG. 9) and circular on the other end (the bottom end in FIG. 9), to receive shaft 42 in such a way that impeller 50 can freely rotate about fixed or freewheeling shaft 42. First leg 62*b* generally extends from shaft recess 62*f* to blade 60*b* whereas second leg 62*c* generally extends from shaft recess 62*f* to blade 60*a*. Legs 62*b* and 62*c* combine to form a distinctly noncircular, somewhat elongate spider body 62*a* which extends radially between blades 60*a* and 60*b*. This shape optimizes the spider for minimum weight and material while giving the required strength and support.

Connected to the outer ends of spider legs 62*b* and 62*c* are blades 60*b* and 60*a*, respectively, and blade braces 62*g* and 62*h*, respectively. Braces 62*g* and 62*h* are located behind their respective blades 60 and assist in supporting, bracing and stiffening blades 60 against distortion under load. Brace 62*g* includes an arcuate edge 62*i* which is on the opposite side of brace 62*g* from blade 60*b* and is in effect an extension of shaft receiving edge 62*e*. Diagonally opposite brace 62*h*, by contrast, includes an arcuate edge 62*j* which is smoothly connected to edge 62*d* on the opposite side of spider body 62*a* from shaft receiving edge 62*e*.

It should also be noted that blades 60 include flange portions 61 to further prevent distortion of blades 60 under load. The concept of such a flange or "strengthening surface" is described in U.S. Pat. No. 4,295,285, issued to Stevens and assigned to the present assignee. While the Stevens blade and flange combination is L-shaped and the preferred blade and flange combination shown herein is more chevron- or V-shaped (with and angle between the blade and flange exceeding 90°), the general concept is similar.

As noted above, inner spider 72 is preferably identical to inner spider 62 except that it is rotated 180° relative thereto. As those skilled in the art will readily recognize, the pairing off of the spiders and the manner in which they are equally spaced from mid plane 80 will result in a statically and dynamically balanced impeller 50: and will also result in a pattern whereby the spiders alternate from one end of impeller 50 to the other, in the sense that spider 62 faces in a first direction (shaft recess up, in Drawing), spider 72 faces in a second direction (shaft recess down), opposite the first direction: spider 64 faces in the second direction (shaft recess down), spider 74 faces in the first direction (shaft recess up): and so on.

Although inner spider 72 is not shown and described in great detail, except to note that it is identical to inner spider 62 but for its orientation, it should be noted that inner spider 72 includes all of the elements and characteristics of inner spider 62, and in fact the same reference numerals could be used to describe both spiders, i.e., spider body 72*a* would correspond to spider body 62*a*, leg 72*b* would correspond to leg 62*b*, and so on. Of course, leg 72*b* would connect to blade 60*a* rather than blade 60*b*, because of the 180° inversion of spider 72 relative to spider 62. In fact, spider 72 is much like spider 64 in terms of its general shape and orientation, e.g., leg 72*b* is shaped and oriented much like leg 64*b* and leg 72*c* is much like leg 64*c*.

Figure 10:
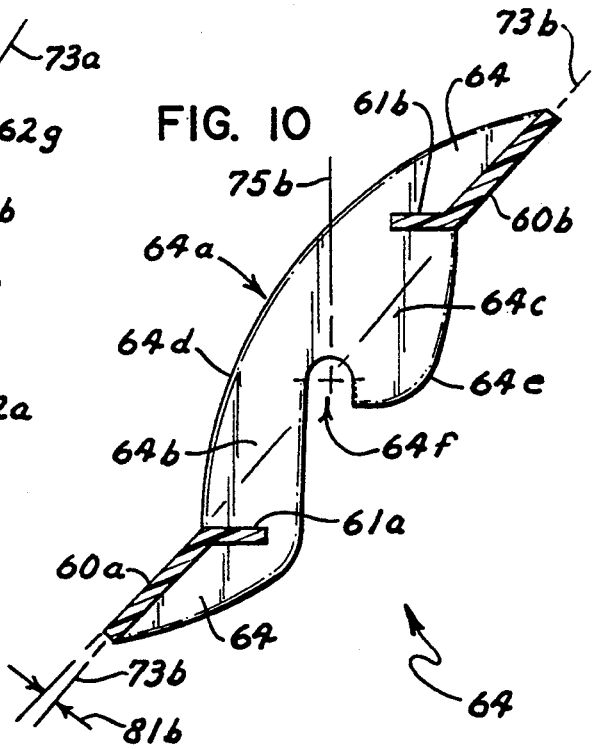
FIG. 10 is a side view, taken generally along line 10—10 of FIG. 3, of one of the mid-inner spiders of the impeller of FIG. 2.
Figure 11:
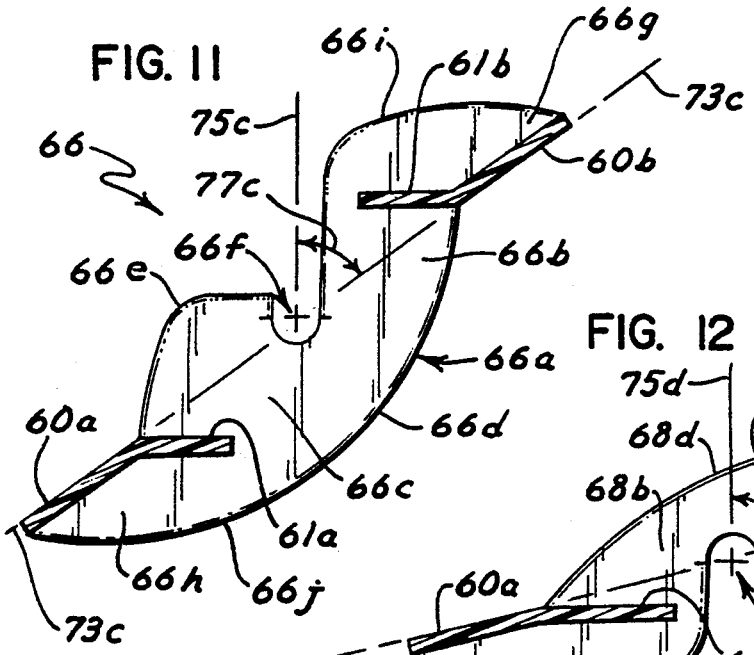
FIG. 11 is a side view, taken generally along line 11—11 of FIG. 3, of one of the mid-outer spiders of the impeller of FIG. 2.
Figure 12:
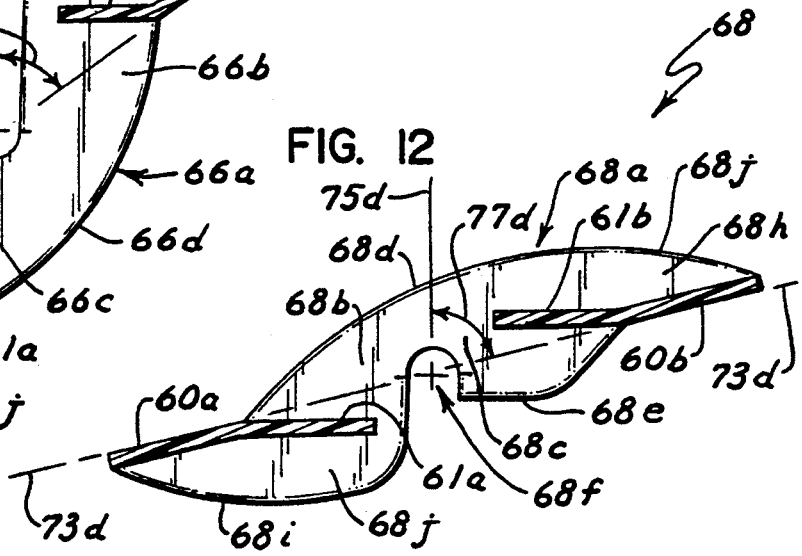
FIG. 12 is a side view, taken generally along line 12—12 of FIG. 3, of one of the outer spiders of the impeller of FIG. 2.

Mid-inner spider 64 is quite similar in general concept to inner spider 62, except for its orientation. The primary difference is that the "legs" 64*b* and 64*c* of mid-inner spider 64 are slightly shorter and wider than the "legs" 62*b* and 62*c* of inner spider 62, shorter because the open space 71 between blades 60*a* and 60*b* decreases with increasing distance from mid plane 80; and wider to offset the reduced lengths of the legs, i.e., to make all of the spiders roughly equal in mass to help maintain the static and dynamic balance of impeller 50. Otherwise, the spiders 62 and 64 are quite similar. And, as noted above, mid-inner spider 74 is preferably identical to mid-inner spider 64, but for the fact that it is rotated 180° relative thereto. With reference to FIGS. 9 and 10, it should be noted that these figures are accurate in the sense that they show the relative relationship between spiders 62 and 64. That is, these spiders in a sense face in opposite directions so that they combine to completely enclose shaft 42. Stated in another way, shaft recess 62*f* faces in one direction (up in Drawing) whereas shaft recess 64*f* faces in the opposite direction (down in Drawing). This relationship holds true between spiders 64 and 66; and between spiders 66 and 68, as well. Also, spider 66 is quite similar to spider 64 except for the fact that its "legs" are shorter and wider than those of spider 64, whose legs are shorter and wider than those of spider 62, as noted above. It can also be seen from FIGS. 9–12 that flanges 61 grow longer with increasing distance from mid plane 80; and the angle between each flange 61 and the corresponding blade 60 grows larger with increasing distance from mid plane 80 as well. At spiders 62 and 72, flanges 61 are about 0.5 inch wide: blades 60 are about 1.5 inches wide: and the angle between flanges 61 and corresponding blades 60 is about 135 degrees. At spiders 68 and 78, flanges 61 are about 1.5 inches wide: blades 60 are about 1.3 inches wide: and the angle between flanges 61 and corresponding blades 60 is about 170 degrees. The angle between the blades and the flanges continues to increase with increasing distance from mid plane 80, so that toward auger sections 63 the blades and flanges are flush for all intents and purposes. The net effect is that the actual snow handling portion of blades 60 is fairly narrow toward mid plane 80 but grows wider toward end plates 52, 54.

In addition, each blade 60 preferably has a 3 to 5 degree forward tilt or "forward facing angle," this concept being disclosed in U.S. Pat. No. 4,694,594, incorporated herein by reference. Actually, referring to FIGS. 9–12, the forward facing angle 81a near inner spiders 62, 72 is about 3 to 5 degrees; the forward facing angle 81*b* near mid-inner spiders 64, 74 is about 2 to 3 degrees; and the forward facing angle is closer to 0 degrees toward the auger-like ends of blades 60.

The preferred distances of the spiders from mid plane 80 are given in the table below:

| | Distance (inch(es)) |
|---|---|
| Spiders 62, 72 | 0.65 |
| Spiders 64, 74 | 2.15 |

-continued

| | Distance (inch(es)) |
|---|---|
| Spiders 66, 76 | 3.65 |
| Spiders 68, 78 | 4.75 |

These distances are measured from the mid plane 80 to the outer edges of the spiders. The spacing between the spiders is important because they must be close enough to adequately brace blades 60 and prevent distortion of blades 60 under load, but they shouldn't be so close (and so many in number) as to unnecessarily waste material, increase weight and rotational inertia, and decrease air flow or snow throw.

The spiders in effect rotate from mid plane 80 out to end plates 52, 54 of impeller 50, due to the curvature of blades 60. A "spider axis" 73 passing through the impeller axis 56 and the inner edges of blades 60 is shown in each of FIGS. 9–12: FIG. 9 shows a spider axis 73*a*, FIG. 10 shows a spider axis 73*b*, and so on. An arbitrary (in FIGS. 9–12, vertical) axis 75 is also shown in FIGS. 9–12, and axes 73 and 75 form angles 77, e.g., FIG. 9 shows an angle 77*a* formed between axes 73*a* and 75*a*, and so on. Angles 77*a*–77*d* are preferably as follows:

| Angle | Degrees |
|---|---|
| 77a | 40 |
| 77b | 45 |
| 77c | 60 |
| 77d | 75 |

Spiders 62, 64, 66, 68, 72, 74, 76 and 78 are fairly elongate and noncircular. Referring to spider 62 shown in FIG. 9, for example, it occupies only about 22% of the total area of a circular spider (e.g., see U.S. Pat. No. 4,295,285) having an outside diameter running from one blade tip to another. Spiders 64, 66 and 68 occupy about 22%, 25% and 18%, respectively, of the circular area. The small area occupied by the spiders contributes to the lightness (overall and rotational inertia) and openness of impeller 50.

Figure 5:
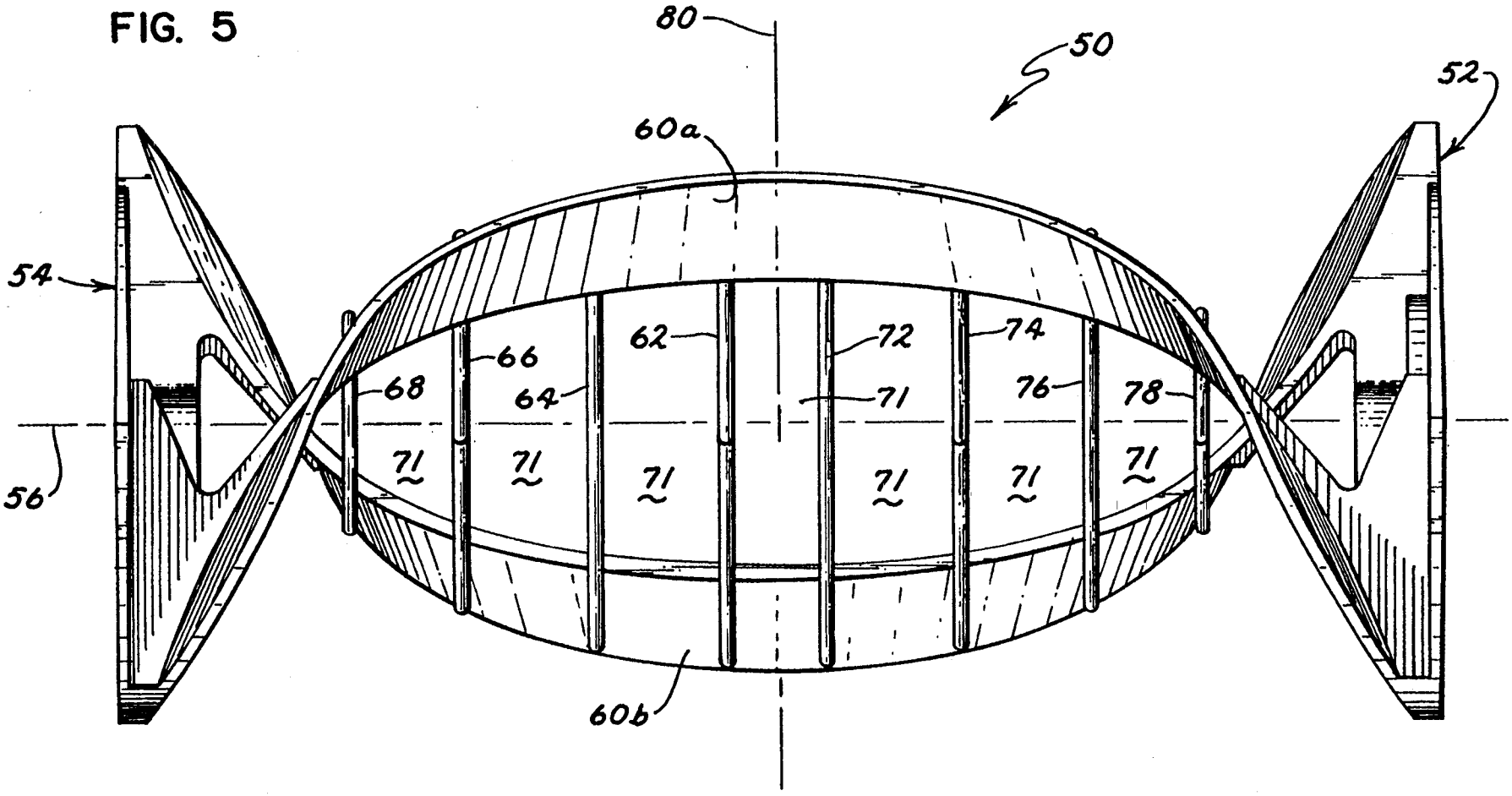
FIG. 5 is a top plan view of the impeller of FIG. 2.
Figure 6:
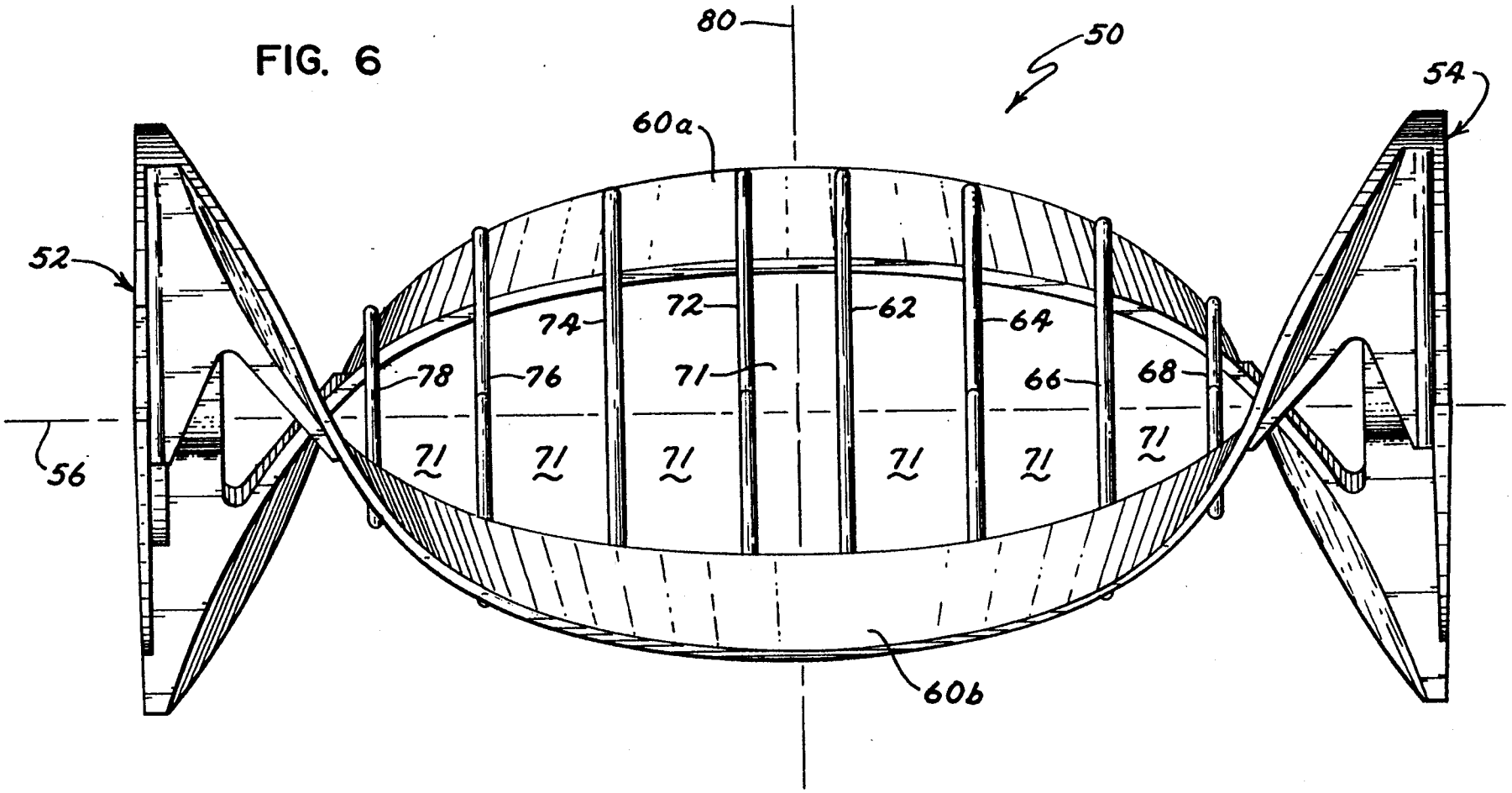
FIG. 6 is a bottom plan view of the impeller of FIG. 2.

The relative "openness" of impeller 50 can also be viewed in terms of the projected open area 71 compared to the entire paddle area, were it entirely solid. For example, referring to FIG. 5, the projected open area 71 between the inner edges of outer spiders 68 and 78 is about 14 square inches. The projected paddle area (the combined projected area of open area 71 and blades 60) is about 23.5 square inches in the preferred embodiment, making impeller 50 about 60% open (in terms of projected area when viewed in the manner of FIG. 5). While about 60% open area is preferred, Applicants believe that projected open area percentages of anywhere from about 40% to 75% would be suitable. Applicants believe that an open center impeller pumps more air and better meters the snow to the blades as compared to a closed center impeller, but the optimum degree of impeller openness is thought to vary depending on a wide variety of factors, including blade width, impeller speed, clearance between blade tips and housing, etc. The snow metering effect seems to help avoid clogging and prime mover overloading. The preferred blade width is between about 1 and 1½ inches.

Figure 7:
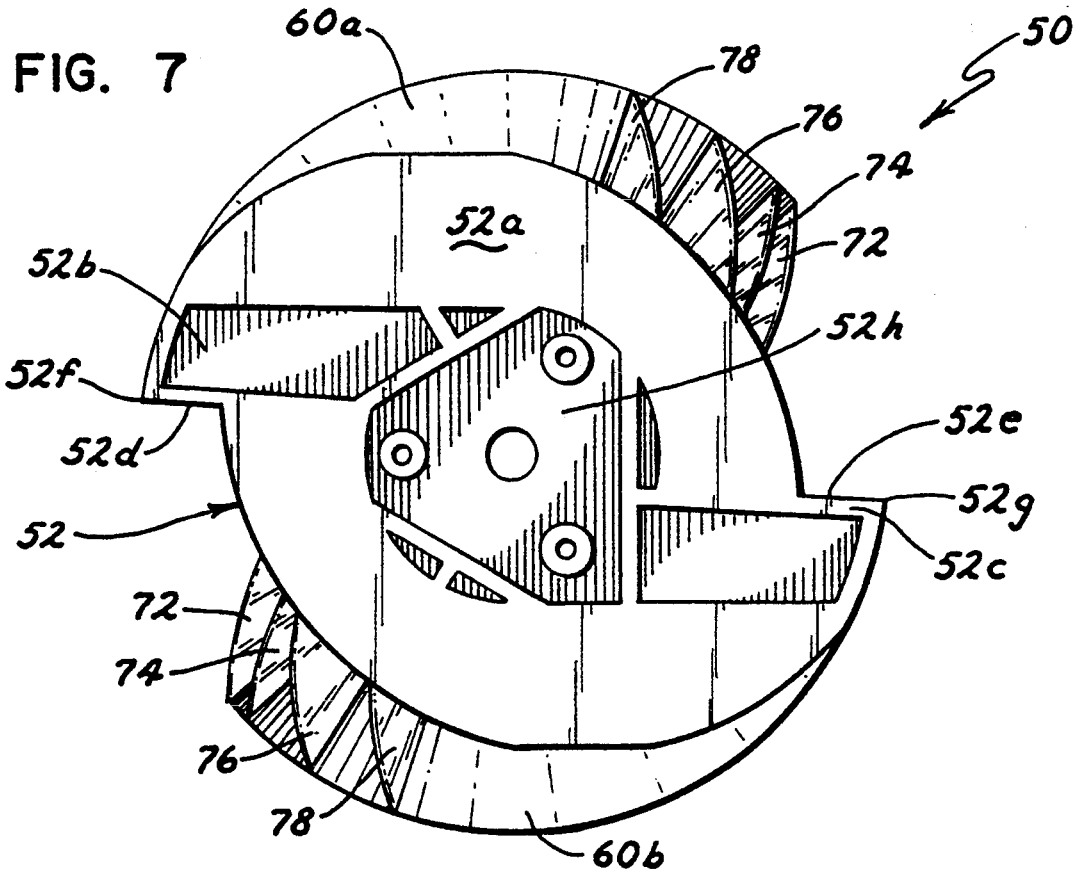
FIG. 7 is a left end elevational view of the impeller of FIG. 2, showing the driven end plate.
Figure 8:
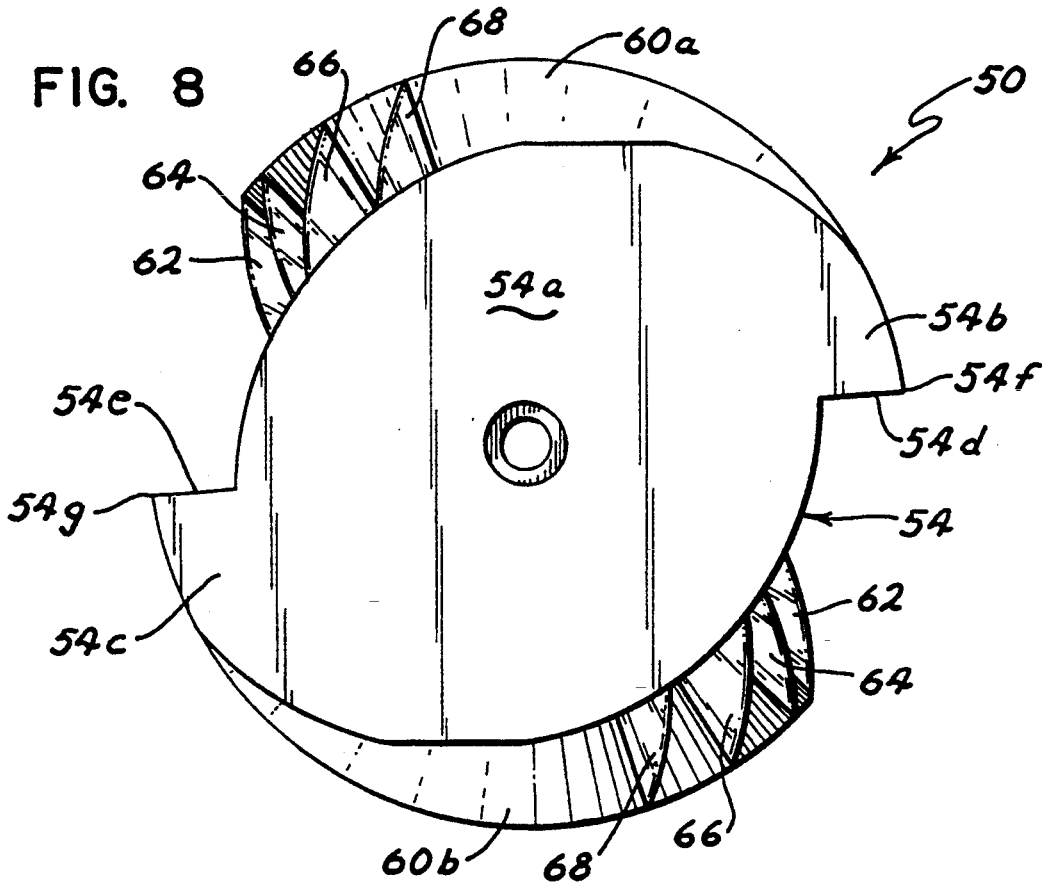
FIG. 8 is a right end elevational view of the impeller of FIG. 2, showing the free end plate.

FIGS. 7 and 8 show end views of impeller 50. FIG. 8, for example, shows free end plate 54 which includes a generally circular inner portion 54*a* which carries a pair of diametrally-opposed teeth 54*b* and 54*c*. Each tooth 54*b* or 54*c* includes a radially-oriented surface 54*d* or 54*e*, respectively, which is preferably about 0.75 inch long. Teeth 54*b* can 54*c* also include a tip 54*f* and 54*g*, respectively. The tip-to-tip distance corresponds to the overall diameter of impeller 50, about 7 inches. Likewise, driven end plate 52 also carries a pair of teeth 52*b* and 52*c*. Tips 54*f*, 54*g*, 52*f* and 52*g* of teeth 54*b*, 54*c*, 52*b* and 52*c* are actually located at the very ends of the auger sections of blades 60. Thus, the teeth of impeller 50 are symmetrically arranged with respect to impeller mid plane 80, with tooth 54*b* being a mirror image of tooth 52*b*, and so on.

In one preferred embodiment, impeller 50 is 7 inches in diameter (measured from tooth 54*b* to tooth 54*c*, for example); 15 inches long (measured between the outer surfaces of end plates 52 and 54); and injection molded in one piece using Dow 080540 high density polyethylene. Polyethylene was chosen primarily because of its relative inexpensiveness, smooth glossy surface, low friction to snow, and cold impact resistance. To injection mold impeller 50, a basic open and shut mold can be used with core pulls at end plates 52, 54. The elongate nature of the spiders, and their half circle shaft recess configuration greatly simplifies the tool in that long core pulls and complicated shut offs are not required. A preferred contoured parting line 110, having steps in the center shaft area, is shown on spider 62. This type of parting line would exist on all of the spiders in the preferred design. The nominal thickness of the spiders and blades is preferably 0.15 inch.

With reference to FIG. 7, driven end plate 52 preferably forms a triangular recess 52*h* which carries a drive means for impeller 50. The "drive means" is preferably coupled to electric motor 100 by means of a belt and pulley system 102, as described above. While in the preferred embodiment a slip clutch is contained within by clutch recess 52*h*, those skilled in the art will recognize that a slip clutch is perhaps not necessary if the drive system possesses enough overall elasticity or strength.

While impeller 50 can have two paddles or blades as shown in the Drawing hereof, it could also have three or more paddles or blades. Additional blades can eliminate some of the vibration and "chattering" often associated with a two-bladed impeller. On the other hand, a three bladed impeller would probably be more difficult to mold.

Referring to FIG. 13, the preferred clearance 112 between the blade tips of impeller 50 and the front surface of arcuate housing portion 38*a* is about 0.060 inch. This is a fairly close fit, but Applicants believe that the small clearance allows very little snow slippage around the ends of the blade tips, making snowthrower 20 more efficient. The "open center" impeller configuration helps prevent stalling, clogging and overloading in spite of the tight blade tip-to-housing fit.

The operation of snowthrower 20 can now be briefly summarized. The operator connects plug 21 to 110 VAC and engages switch bar 23. The energized motor 100 imparts rotation to impeller 50 through belt and pulley transmission 102. Blades 60 engage the snow and draw it into the housing and against arcuate housing portion 38*a*, while blade auger portions 63 feed snow inwardly toward blade central sections 61. The snow is then thrown upwardly into a stream and through chute 30 by blade central sections 61, out of housing 22 and away from snowthrower 20 in a preselected direction. Teeth 52*b*, 52*c*, 54*b* and 54*c* help to break up crusted snow and ice, and even assist in propelling snowthrower 20 forwardly, to a degree. The open center configuration of impeller 50 helps prevent stalling, clogging and overloading, by allowing some "slippage" toward the center of the impeller; while at the same time a close fit (preferably 0.060 inch) is maintained between the blade tips and the housing to minimize energy-wasting snow slippage at the blade tips.

There are other modifications which will be apparent to those skilled in the art. Accordingly, the scope of this invention will be limited only by the appended claims.

We claim:

1. An impeller for a single stage snowthrower of the type having a housing, a through shaft mounted in the housing and a prime mover, the impeller being mountable on the through shaft within the housing and comprising:

(a) a pair of end plates, at least one of the end plates being operatively coupled to the prime mover;

(b) a pair of circumferentially spaced curved blades extending laterally between the end plates, each blade having a front face and a rear face, wherein each blade comprises:

(i) a central snowthrowing section curved forwardly from a mid plane to each side thereof to be concave; and (ii) a pair of curved auger sections smoothly connected to the sides of the central section and adjacent to the end plates; and (c) a plurality of thin, elongate spiders extending radially between the blades, wherein:

(i) the impeller forms a substantially open center and is made from a single piece of plastic;

(ii) connected to the end of each spider is a brace;

(iii) the braces contact the blade rear faces and the blade front faces are not obstructed by the spiders or by the braces; and (iv) the spiders being formed with recesses for receiving the snowthrower through shaft.

2. The impeller of claim 1, wherein the end plates comprise teeth suitable for breaking up snow and ice and propelling the snowthrower.

3. The impeller of claim 1, wherein the impeller is fabricated from a single piece of injection-molded plastic.

4. The impeller of claim 1, wherein torque is transmitted from one end plate to another primarily through the curved blades.

5. The impeller of claim 3, wherein the plastic is high density polyethylene.

6. The impeller of claim 1, wherein in projected area the impeller is about 60% open.

7. The impeller of claim 4, wherein the shaft recesses alternate from one end of the impeller to the other such that they face in a first direction or a second direction opposite the first direction.

8. The impeller of claim 1, wherein there is a pair of inner spiders; a pair of mid-inner spiders; a pair of mid-outer spiders; and a pair of outer spiders; wherein each spider of each pair of spiders is spaced an equal distance from the mid plane as the other spider in the pair.

9. The impeller of claim 6, wherein the spiders are thin compared to the overall width of the impeller.

10. The impeller of claim 4, wherein the snowthrower through shaft is not actively driven by the snowthrower prime mover.

11. The impeller of claim 2, wherein each blade comprises a blade tip and wherein each end plate comprises a generally circular portion from which extends the teeth and the diameter of the generally circular portion is smaller than the maximum distance between the blade tips, whereby the teeth will tend to dig into the snow and ice.

12. A single stage snowthrower of the type having a housing, through shaft mounted in the housing and a prime mover, and a rotatable impeller mounted on the through shaft within the housing, the impeller comprising:

(a) a pair of end plates, at least one of the end plates being operatively coupled to the prime mover;

(b) a pail of circumferentially spaced curved blades extending laterally between the end plates, each blade having a front face and a rear face, wherein each blade comprises:

(i) a central snowthrowing section curved forwardly from a mid plane to each side thereof to be concave; and (ii) a pair of curved auger sections smoothly connected to the sides of the central section and adjacent to the end plates; and (c) a plurality of thin, elongate spiders extending radially between the blades, wherein;

(i) the impeller forms a substantially open center and is made from a single piece of plastic;

(ii) connected to the end of each spider is a brace;

(iii) the braces contact the blade rear faces and the blade front faces are not obstructed by the spiders or by the braces; and (iv) the spiders being formed with recesses for receiving the snowthrower through shaft.

* * * * *